US007273460B1

(12) United States Patent
Nan

(10) Patent No.: US 7,273,460 B1
(45) Date of Patent: Sep. 25, 2007

(54) MASSAGE APPARATUS SYSTEM

(75) Inventor: Simon Siu Man Nan, Richmond Hill (CA)

(73) Assignee: Nanma Manufacturing Co. Ltd., Hong Kong (HK)

( * ) Notice: Subject to any disclaimer, the term of this patent is extended or adjusted under 35 U.S.C. 154(b) by 143 days.

(21) Appl. No.: 11/471,783

(22) Filed: Jun. 21, 2006

(51) Int. Cl.
*A61H 7/00* (2006.01)

(52) U.S. Cl. ..... 601/98; 601/99; 601/101

(58) Field of Classification Search ..... 601/97–112, 601/116, 122, 126.128
See application file for complete search history.

(56) References Cited

U.S. PATENT DOCUMENTS 5,076,261 A 12/1991 Black
5,417,644 A * 5/1995 Lee ..... 601/98
5,877,570 A * 3/1999 Chen ..... 310/75 R
6,402,709 B1 * 6/2002 Wu ..... 601/98
6,662,386 B1 * 12/2003 Bowerman ..... 4/606
6,890,293 B2 5/2005 Kobayashi

* cited by examiner

*Primary Examiner*—Michael A. Brown
(74) *Attorney, Agent, or Firm*—Greensfelder, Hemker & Gale, PC; Peter S. Gilster

(57) ABSTRACT

A massage apparatus system for providing an automatic simulated sexual action is disclosed. The massage apparatus system includes an inflatable mattress defining a distal portion and a proximal portion with the distal portion defining a recess and an inflatable housing having a massage apparatus disposed therein which includes an output shaft engaged to a prosthetic member. Operation of the massage apparatus causes the prosthetic member to move in a reciprocating manner such that a simulated sexual action is produced by the prosthetic member.

21 Claims, 5 Drawing Sheets

MASSAGE APPARATUS SYSTEM

FIELD

The present document relates to a massage apparatus system, and more particularly to a massage apparatus system capable of simulated sexual action.

SUMMARY

In an embodiment, the massage apparatus system may include an inflatable mattress, the inflatable mattress defining a distal portion and a proximal portion, the distal portion defining a recess, an inflatable housing defining an aperture, the inflatable housing being adapted to be detachably disposed within the recess, and a massage apparatus disposed inside the inflatable housing, the massage apparatus including a motion driving unit for providing a simulated sexual action by a prosthetic member, the motion driving unit including a sliding mechanism in operative engagement with a gear box assembly for providing the simulated sexual action by the prosthetic member, the sliding mechanism including an output shaft inserted through the aperture of the inflatable housing and being operatively associated with the prosthetic member for moving the prosthetic member in the simulated sexual action by the motion driving unit.

In another embodiment, a massage apparatus system comprising an inflatable mattress, the inflatable mattress defining a recess, an inflatable housing defining an aperture, the inflatable being adapted to be engageable with the recess, a massage apparatus disposed inside the inflatable housing, the massage apparatus including a motion driving unit having a gear box assembly operatively engaged to a sliding mechanism, said sliding mechanism including a sliding block which is operatively engaged to said gear box assembly such that operation of said gear box assembly causes a reciprocating motion by the sliding block.

In yet another embodiment, a massage apparatus comprising a motion driving unit, the motion driving unit including a gear box assembly in operative engagement with a sliding block through a driving wheel, the driving wheel adapted to be rotated when the gear box assembly in is operation, the sliding block being slidably disposed inside a housing for moving the sliding block in a reciprocating motion within the housing, the sliding block defining a slot and the driving wheel defining a cylindrical block adapted for movement inside the slot, wherein rotation of the driving wheel by the gear box assembly causes the cylindrical block to move within the slot such that the sliding block is caused to be moved in the reciprocating motion within the housing.

Implementation of the above embodiments may include one or more of the following features:

The proximal portion of the mattress defines a plurality of rib portions.

The mattress includes a plurality of fastening members.

The inflatable housing includes a Velcro member for detachably disposing the inflatable housing relative to the recess of the mattress.

The output shaft is operatively associated with the prosthetic member through a connection mechanism.

The mattress defines an ergonomic surface.

The motion driving unit further includes a battery unit in operative association with the sliding mechanism.

The sliding mechanism defines a sliding block defining a slot in communication with the output shaft, wherein movement of the sliding block produces the simulated sexual action.

The sliding mechanism includes a pair of guiding plates operatively engaged to the sliding block.

The gear assembly includes a motor with the motor including a motor shaft operatively engaged to a gear member for actuating a driving wheel that drives the sliding mechanism.

The gear box assembly is operatively engaged to an electric motor for causing rotation of first gear member, second gear member and a third gear member in opposite direction relative to on another.

The electric motor includes a motor shaft having a first pinion gear operatively engaged to the first gear member such that rotation of the first pinion gear in one direction causes the first gear member to rotate in an opposite direction.

The first gear member includes a second pinion gear, the second pinion gear in operative engagement with the second gear member such that rotation of second pinion gear in the opposite direction causes the second gear member to rotate in the one direction.

The second gear member includes a third pinion gear with the third pinion gear in operative engagement with the third gear member such that rotation of the third pinion gear in the one direction causes the third gear member to rotate in the opposite direction, the third gear member including an output shaft which rotates in the opposite direction, the output shaft operatively engaged to a driving wheel for rotating the driving wheel in the opposite direction.

The sliding block includes an output shaft which moves the output shaft in the reciprocating motion.

The output shaft includes a coupling member with coupling member being engageable to a hollow prosthetic member for moving the prosthetic member in the reciprocating motion.

The motion driving machine includes a sliding mechanism having sliding block defining a slot with the driving wheel defining a cylindrical block in operative engagement with the slot for movement along the slot as the driving wheel is rotated by the gear box assembly.

The sliding block includes an output shaft with the output shaft being coupled to a hollow prosthetic member such that movement of the sliding block causes the hollow prosthetic member to move in the reciprocating motion.

The output shaft is coupled to the hollow prosthetic member through a coupling member.

Additional features will be set forth in the description which follows or will become apparent to those skilled in the art upon examination of the drawings and detailed description which follows.

BRIEF DESCRIPTION OF THE DRAWINGS

Corresponding reference characters indicate corresponding elements among the view of the drawings.

DETAILED DESCRIPTION

Figure 1:
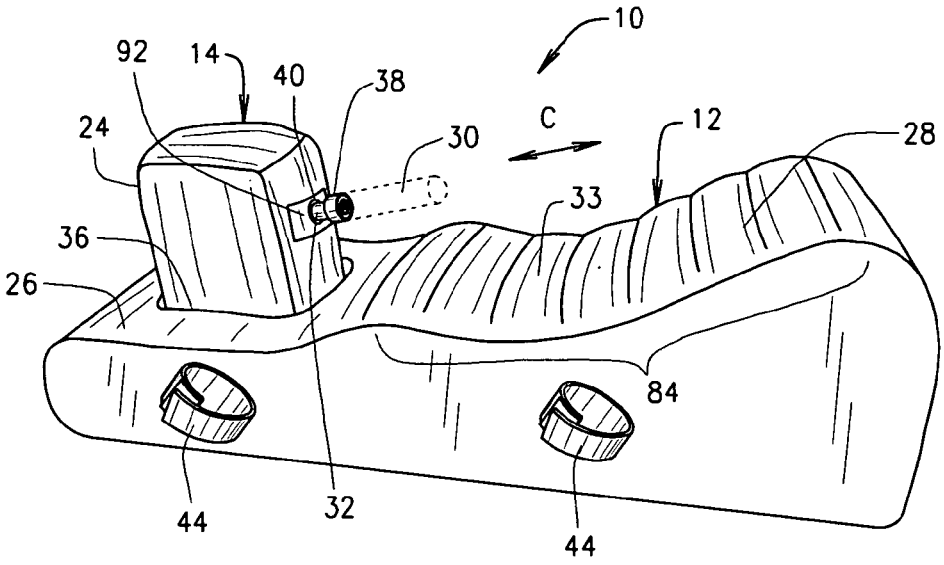
FIG. 1 is a perspective view of a massage apparatus system.

Referring to the drawings, a massage apparatus system is illustrated and generally indicated as 10 in FIGS. 1-8. In one embodiment, massage apparatus system 10 may include an inflatable mattress 12 operatively associated with a massage apparatus 14 for providing a simulated sexual action as shall be discussed in greater detail below Referring to FIG. 1, inflatable mattress 12 defines a pliable, inflatable hollow body 23 defining a proximal portion 26 and a distal portion 28. Distal portion 28 of the hollow body 23 may define an ergonomically-shaped surface 33 having a plurality of rib portions 84 adapted to comfortably receive a user, while the proximal portion 26 defines a recess 36 adapted to receive a pliable, inflatable housing 24 for encasing the massage apparatus 14. As such, the inflatable housing 24 may be seated in recess 36 during operation of the massage apparatus 14 and removed from recess 36 once operation of the massage apparatus 14 has terminated, if desired.

In one embodiment, the hollow body 23 may include a pair of fastening members 44 on opposing sides of hollow body 23 each having Velcro portions 46 that permit the user to fasten and unfasten the fastening members 44 around the arms and/or legs of the user if desired. In an alternative embodiment, fastening members 44 may be used to secure the inflatable mattress 12 to one or more stationary structures in order to hold the inflatable mattress 12 securely in place during operation of the massage apparatus 14.

As further shown, inflatable housing 24 may include a mounting plate 92 defining an aperture 40 having an output shaft 32 (FIG. 3) engaged to a connection mechanism 38 which is inserted through aperture 40 such that the connection mechanism 38 may moved in a reciprocating motion by the output shaft 32 such that a simulated sexual action is provided. In addition, a prosthetic member 30 may be attached to the connection mechanism 38 for moving the prosthetic member 30 in a simulated sexual action by the output shaft 32.

Figure 2A:
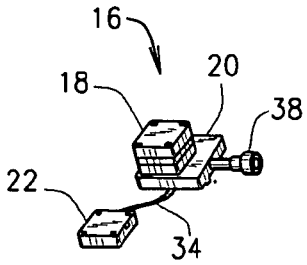
FIG. 2A is an enlarged view of a motion driving unit for the massage apparatus system shown in FIG. 2.
Figure 2:
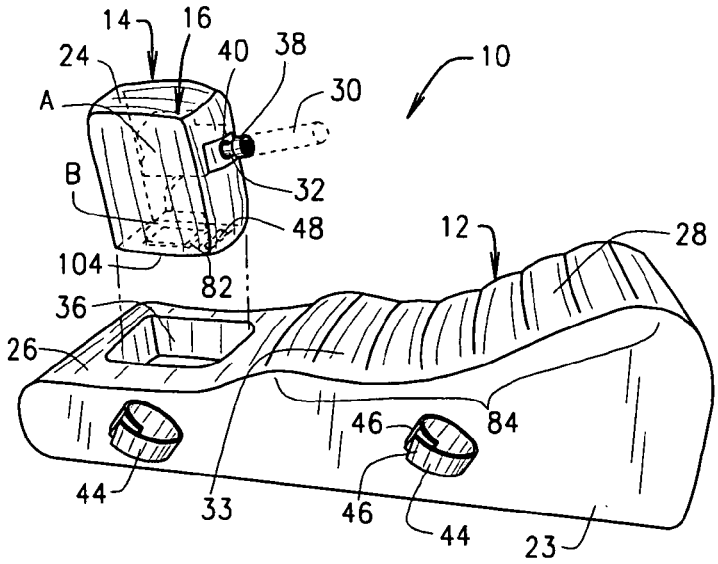
FIG. 2 is an exploded view of the massage apparatus system.

Referring to FIG. 2, massage apparatus 14 may include a motion driving unit 16 for moving the prosthetic member 30 in a simulated sexual action, such as a reciprocating back and forth motion C. In the alternative, the simulated sexual action may be an off-centered reciprocating back and forth motion. Motion driving unit 16 may include a gear box assembly 18 operatively engaged to a sliding mechanism 20 which is operatively engaged to the output shaft 32 for imparting the simulated sexual action to the prosthetic member 30. In addition, sliding mechanism 20 may be operatively associated with a battery unit 22 through a pair of cables 34 for providing the necessary power to massage apparatus 14.

In one embodiment, gear box assembly 18 may be mounted on top of sliding mechanism 20 and secured at a position A inside inflatable housing 24, while the battery unit 22 may be secured at a position B inside inflatable housing 24 as illustrated in FIG. 2. As further shown, inflatable housing 24 may include a bottom portion 104 that defines an opening 82 which provides an entrance into the inflatable housing 24 for assembling the various components of the motion driving unit 16 inside inflatable housing 24. A Velcro member 48 may be mounted on the outer surface of the inflatable housing 24 along the bottom portion 104 thereof which is adapted to engage another Velcro member (not shown) located inside recess 36 such that inflatable housing 24 may be secured to the inflatable mattress 12.

Figure 3:
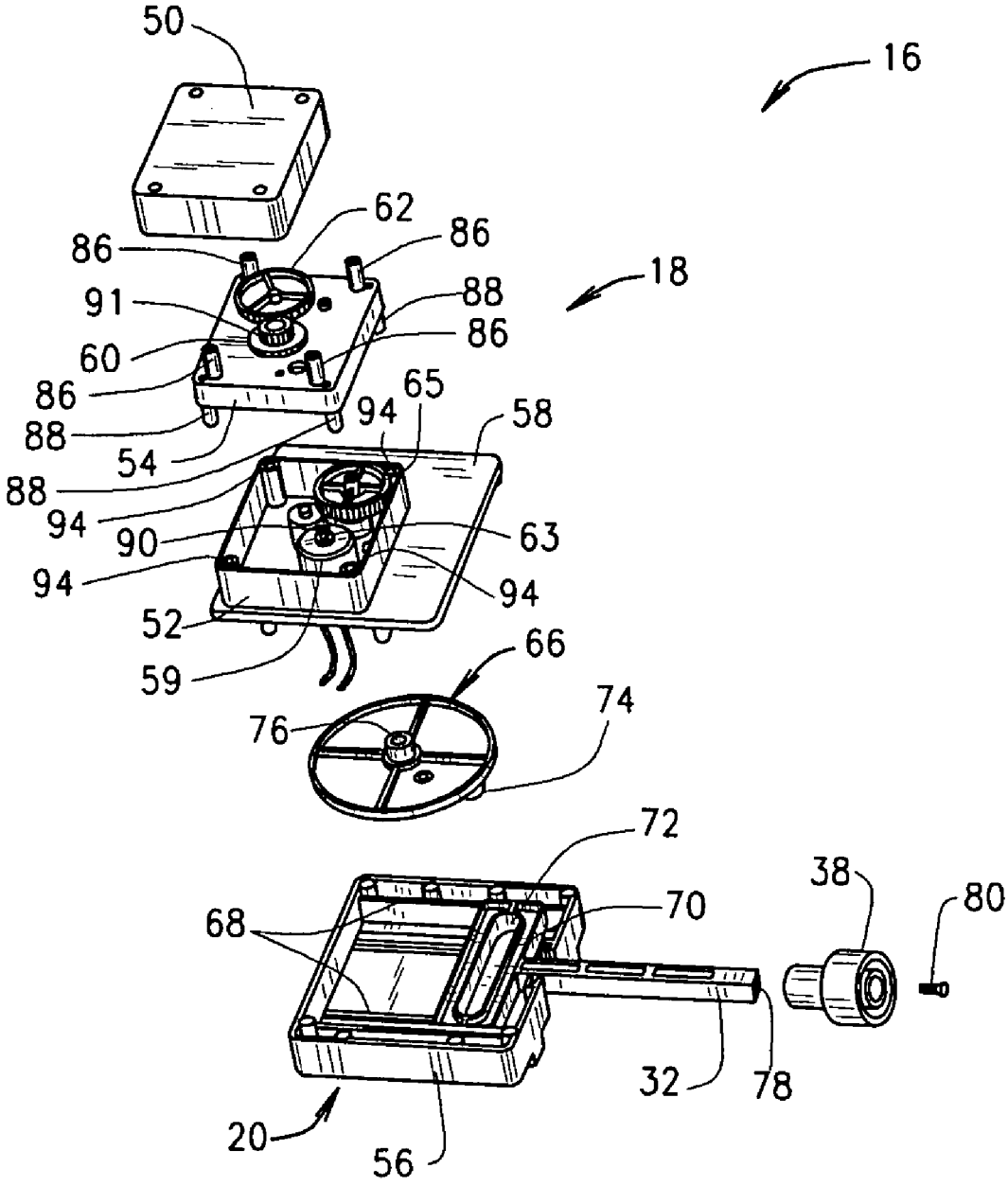
FIG. 3 is an exploded view of a motion driving unit of the massage apparatus system.
Figure 4:
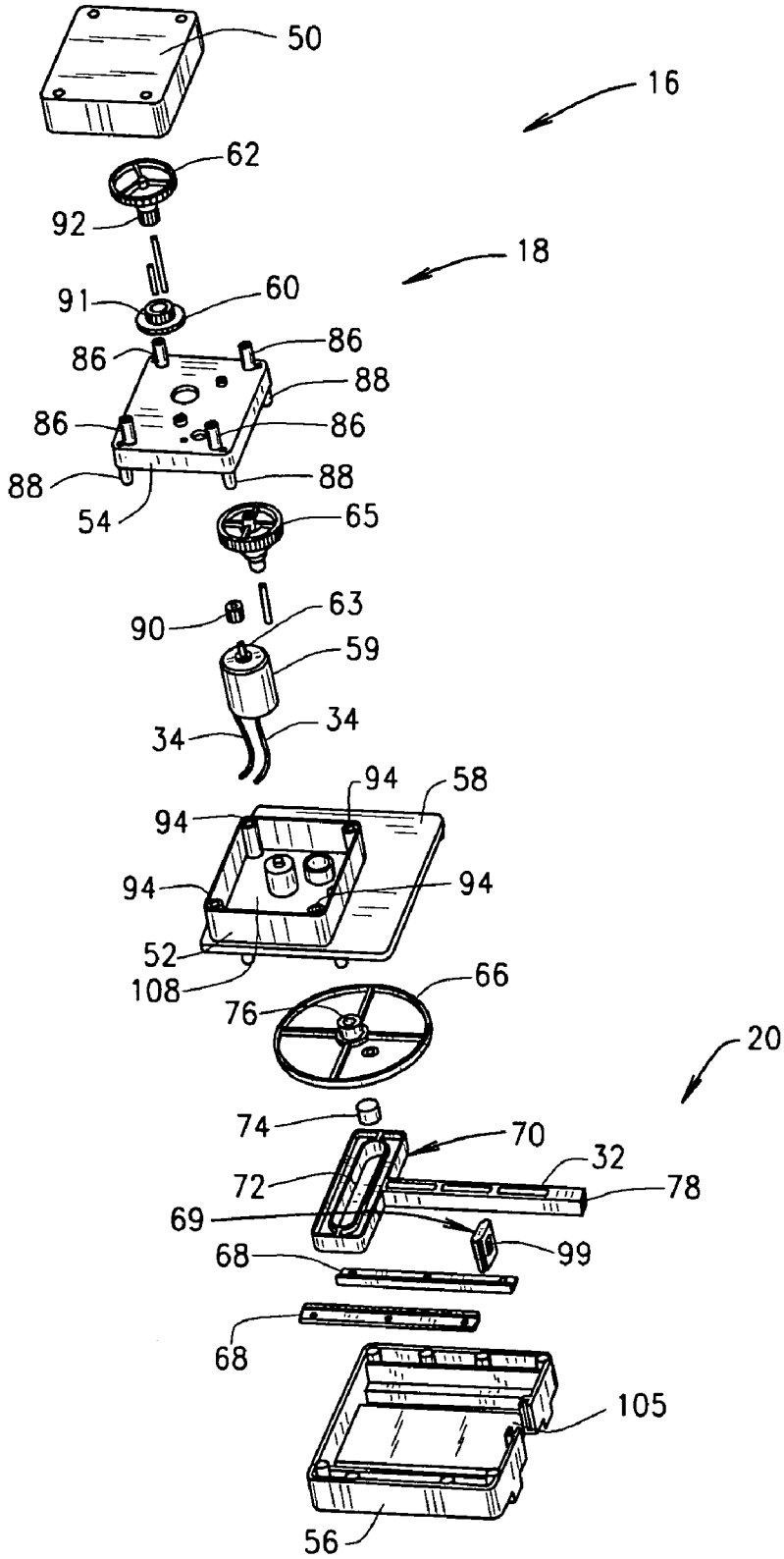
FIG. 4 is another exploded view of the motion driving unit.

Referring to FIGS. 3 and 4, gear box assembly 18 may include an upper casing 50 engaged to a lower casing 52 with a middle plate 54 interposed between casings 50, 52 which encases the various components of the gear box assembly 18. Lower casing 52 may be engaged to a cover 58 of sliding block 70. As further shown, middle plate 54 may include a plurality of upper rods 86 adapted to engage respective slots (not shown) defined by upper casing 50. In addition, middle plate 54 may include a plurality of lower rods 88 positioned on the opposite side of middle plate 54 which are adapted to engage respective slots 94 defined by lower casing 52. In assembly, the upper casing 50 and middle plate 54 collectively define a space (not shown), while the middle plate 54 and lower casing 52 collectively define a space 108 for housing a different portion of gear box assembly 18.

Figure 5:
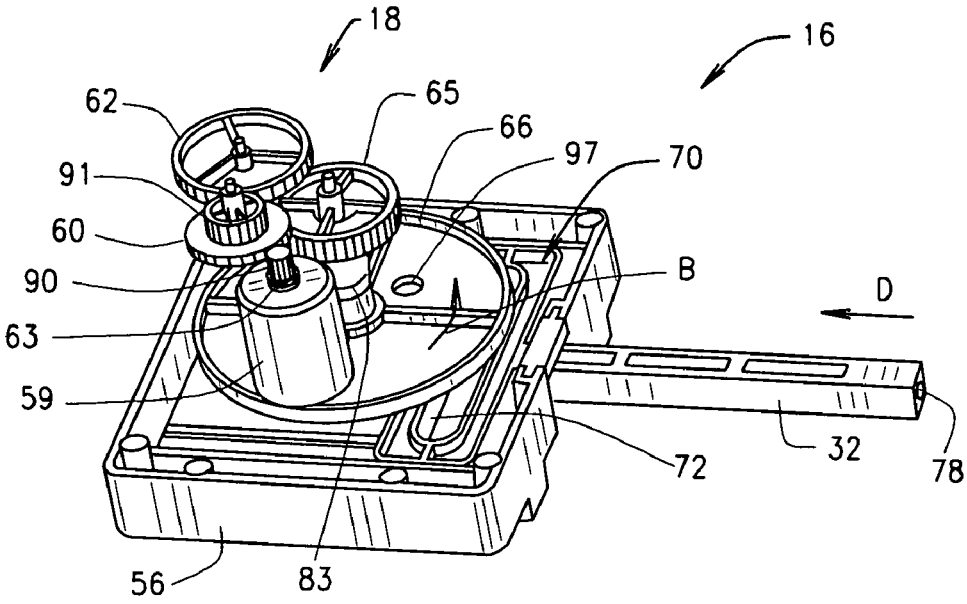
FIG. 5 is a perspective view of the motion driving unit showing the output shaft in the fully extended position.
Figure 8:
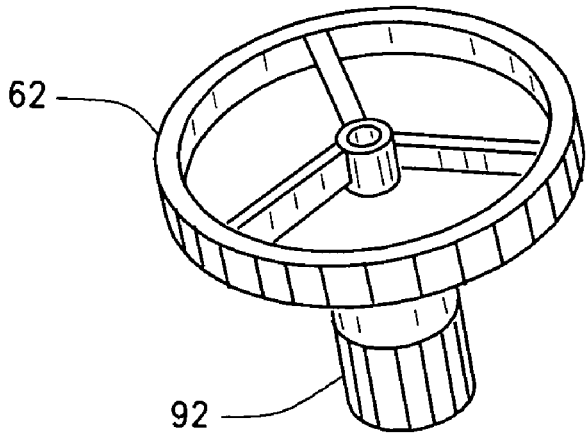
FIG. 8 is an enlarged view of FIG. 5 illustrating the first gear member.

Referring to FIGS. 4, 5, and 8, gear box assembly 18 may include an electric motor 59 having a motor shaft 63 with a pinion gear 90 operatively engaged to a first gear member 60 mounted on middle plate 54. First gear member 60 may include a pinion gear 91 which may be operatively engaged to a second gear member 62 having a pinion gear 92 (FIG. 8). As shown, pinion gear 92 is operatively engaged to a third gear member 65 having an output shaft 83. In addition, output shaft 83 may be engaged to a driving wheel 66 in a manner that causes driving wheel 66 to rotate when output shaft 83 is rotated.

Specifically, driving wheel 66 may define a square centered hole 76 adapted to engage the output shaft 83. In addition, driving wheel 66 may further define a cylindrical block 74 which is fixed eccentrically to the driving wheel 66.

Figure 6:
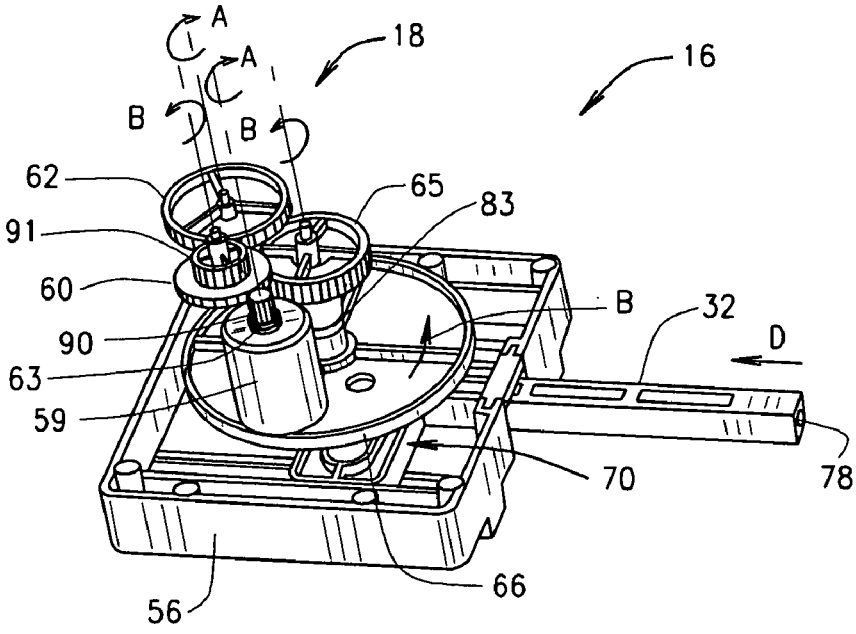
FIG. 6 is a perspective view of the motion driving unit showing the output shaft in the intermediate extended position.

Referring to FIG. 6, in operation, electric motor 59 may rotate pinion gear 90 in direction A such that first gear member 60 is rotated in direction B. Similarly, the rotation of first gear member 60 in direction B rotates second gear member 62 in direction A by virtue of its rotational engagement with pinion gear 91. As second gear member 62 rotates in direction A, pinion gear 92 causes third gear member 65 to rotate in the opposing direction B such that output shaft 83 is rotated in the same direction B. This rotation of output shaft 83 causes driving wheel 66 to also rotate in the same direction B. In alternative embodiment, the electric motor 59 may rotate pinion gear 90 in direction B rather than direction A such that driving wheel 66 is rotated in direction A instead of direction B.

Sliding mechanism 20 may include housing 56 having sliding block 70 adapted to move in a reciprocating manner while the driving wheel 66 is rotated by the gear assembly 18. As shown, sliding block 70 defines a slot 72 with the sliding block 70 being capable of being slidably moved in a reciprocating manner inside housing 56. The output shaft 32 extends outwardly from sliding block 70 through a base plate 69 defining an aperture 99 adapted to slidably engage output shaft 32 such that the reciprocating motion of the sliding block 70 within housing 56 concurrently moves output shaft 32 in a reciprocating motion. Base plate 69 may be adapted to be retained within an opening 105 defined by housing 56. Cylindrical block 74 of driving wheel 66 in direction B may be engaged to slot 72 such that cylindrical block 74 has a restricted sliding action within slot 72 when the driving wheel 66 in direction B is rotated as described above. A pair of guiding plates 68 may be disposed on opposing sides inside housing 56 in order to restrict the reciprocating movement of the sliding block 70 within housing 56. This restricted reciprocating movement produces the simulated sexual action of the prosthetic member 30 as the sliding block 70 moves in a reciprocating manner inside housing 56.

Referring to FIGS. 5-8, the sequence of motion for producing the reciprocating by the output shaft 32 is illustrated. Rotation of the driving wheel 66 by the electric motor 59 causes the output shaft 32 to move in a reciprocating back and forth motion due to the operative moving engagement of the cylindrical block 74 within slot 72. In this manner the reciprocating motion C of the output shaft 32 provides a simulated sexual action to the prosthetic member 30 engaged to the connection mechanism 38 of the massage apparatus 14.

Referring to FIG. 5, output shaft 32 is shown in the fully extended position and may include a center hole 78 adapted for receiving a screw 80 (FIG. 3) for engaging the connection mechanism 38 to the output shaft 32. In one embodiment, prosthetic member 30 may be engaged to the connection mechanism 38 for moving the prosthetic member 30 in a reciprocating motion when the motion driving unit 16 is made operational.

In the intermediate extended position shown in FIG. 6, the output shaft 32 moves in rearward direction D as driving wheel 66 continues to be rotated in direction B by gear box assembly 18. In this position, sliding block 70 is being driven rearward in direction D between guiding plates 68.

Figure 7:
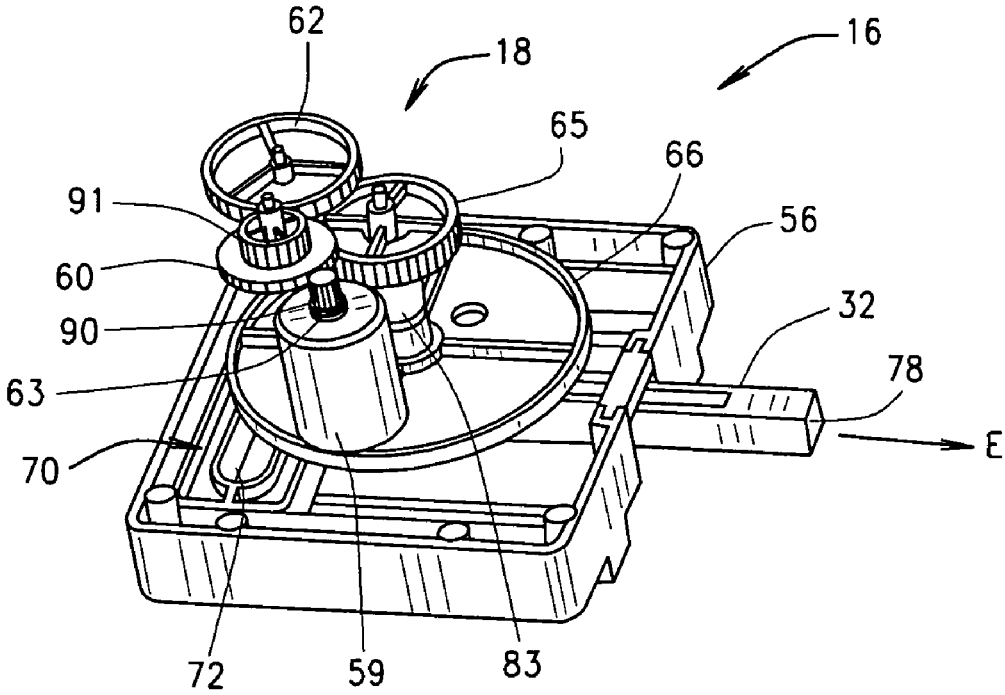
FIG. 7 is a perspective view of the motion driving unit showing the output shaft in the fully withdrawn position.

Referring to FIG. 7, output shaft 32 is shown in the fully retracted position such that sliding block 70 now abuts housing 56 as the rearward travel of the output shaft 32 ends. In this position, sliding block 70 cannot be driven any further in rearward direction D. After the output shaft 32 has reached the fully retracted position, rotation of driving wheel 66 causes output shaft 32 to move in an opposite forward direction E, shown in FIGS. 5-8 such that a reciprocating motion C is produced by the output shaft 32 such that simulated sexual action is generated by the prosthetic member 30.

It should be understood from the foregoing that, while particular embodiments have been illustrated and described, various modifications can be made thereto without departing from the spirit and scope of the invention as will be apparent to those skilled in the art. Such changes and modifications are within the scope and teaching of this invention as defined in the claims appended hereto.

The invention claimed is:

1. A massage apparatus system comprising:

an inflatable mattress, said inflatable mattress defining a distal portion and a proximal portion, said distal portion defining a recess, an inflatable housing defining an aperture, said inflatable housing being adapted to be detachably disposed within said recess, and a massage apparatus disposed inside said inflatable housing, said massage apparatus including a motion driving unit for providing a simulated sexual action by a prosthetic member, said motion driving unit including a sliding block in operative engagement with a gear box assembly for providing said simulated sexual action by said prosthetic member, said sliding mechanism including an output shaft inserted through said aperture of said inflatable housing and being operatively associated with said prosthetic member for moving said prosthetic member in said simulated sexual action by said motion driving unit.

2. The massage apparatus system according to claim 1, wherein said proximal portion of said mattress defines a plurality of rib portions.

3. The massage apparatus system according to claim 1, wherein said mattress includes a plurality of fastening members.

4. The massage apparatus system according to claim 1, wherein said inflatable housing includes a hook and loop member for detachably disposing said inflatable housing relative to said recess of said mattress.

5. The massage apparatus system according to claim 1, wherein said output shaft is operatively associated with said prosthetic member through a connection mechanism.

6. The massage apparatus system according to claim 1, wherein said mattress defines an ergonomic surface.

7. The massage apparatus system according to claim 1, wherein said motion driving unit further includes a battery unit in operative association with said sliding mechanism.

8. The massage apparatus system according to claim 1, wherein said sliding block defines a slot in communication with said output shaft, wherein movement of the sliding block produces said simulated sexual action.

9. The massage apparatus system according to claim 8, wherein said sliding mechanism includes a pair of guiding plates operatively engaged to said sliding block.

10. The massage apparatus system according to claim 1, wherein said gear assembly includes a motor, said motor including a motor shaft operatively engaged to a gear member for actuating a driving wheel that drives said sliding block.

11. A massage apparatus system comprising:

an inflatable mattress, said inflatable mattress defining a recess, an inflatable housing defining an aperture, said inflatable being adapted to be engageable with said recess, a massage apparatus disposed inside said inflatable housing, said massage apparatus including a motion driving unit having a gear box assembly operatively engaged to a sliding mechanism, said sliding mechanism including a sliding block which is operatively engaged to said gear box assembly such that operation of said gear box assembly causes a reciprocating motion by the sliding block.

12. The massage apparatus system according to claim 11, wherein the gear box assembly is operatively engaged to an electric motor for causing rotation of first gear member, second gear member and a third gear member in opposite direction relative to on another.

13. The massage apparatus system according to claim 12, wherein said electric motor includes a motor shaft having a first pinion gear operatively engaged to said first gear member such that rotation of said first pinion gear in one direction causes the first gear member to rotate in an opposite direction.

14. The massage apparatus system according to claim 12, wherein said first gear member includes a second pinion gear, said second pinion gear in operative engagement with said second gear member such that rotation of second pinion gear in said opposite direction causes said second gear member to rotate in said one direction.

15. The massage apparatus system according to claim 14, wherein said second gear member includes a third pinion gear, said third pinion gear in operative engagement with said third gear member such that rotation of said third pinion gear in said one direction causes said third gear member to rotate in said opposite direction, said third gear member including an output shaft which rotates in said opposite direction, said output shaft operatively engaged to a driving wheel for rotating said driving wheel in said opposite direction.

16. The massage apparatus system according to claim 11, wherein said sliding block includes an output shaft which moves said output shaft in said reciprocating motion.

17. The massage apparatus system according to claim 16, wherein said output shaft includes a coupling member, said coupling member being engageable to a hollow prosthetic member for moving said prosthetic member in said reciprocating motion.

18. The massage apparatus system according to claim 15, wherein said sliding block defines a slot, said driving wheel defining a cylindrical block in operative engagement with said slot for movement along said slot as said driving wheel is rotated by said gear box assembly.

19. A massage apparatus comprising:

a motion driving unit, said motion driving unit including a gear box assembly in operative engagement with a sliding block through a driving wheel, said driving wheel adapted to be rotated when said gear box assembly in is operation, said sliding block being slidably disposed inside a housing for moving the sliding block in a reciprocating motion within said housing, said sliding block defining a slot and said driving wheel defining a cylindrical block adapted for movement inside said slot, wherein rotation of said driving wheel by said gear box assembly causes said cylindrical block to move within said slot such that said sliding block is caused to be moved in said reciprocating motion within said housing.

20. The massage apparatus system according to claim 19, wherein said sliding block includes an output shaft, said output shaft being coupled to a hollow prosthetic member such that movement of said sliding block causes said hollow prosthetic member to move in said reciprocating motion.

21. The massage apparatus system according to claim 20, wherein said output shaft is coupled to said hollow prosthetic member through a coupling member.

* * * * *